United States Patent [19]

Bertaud

[11] Patent Number: 4,459,195

[45] Date of Patent: Jul. 10, 1984

[54] CELL FOR THE ELECTROLYTIC PRODUCTION OF METALS FROM METAL HALIDES

[75] Inventor: Yves Bertaud, St. Jean-de-Maurienne, France

[73] Assignee: Aluminum Pechiney, Lyons, France

[21] Appl. No.: 369,583

[22] Filed: Apr. 19, 1982

[30] Foreign Application Priority Data

May 29, 1981 [FR] France ..... 81 11021

[51] Int. Cl.[3] ..... C25C 3/06; C25C 3/00

[52] U.S. Cl. ..... 204/243 R; 204/268; 204/288; 204/280

[58] Field of Search ..... 204/268, 243 R, 67, 204/288, 266, 280, 229

[56] References Cited

U.S. PATENT DOCUMENTS

| | | | |
|---|---|---|---|
| 659,655 | 10/1900 | Edser | 204/270 |
| 4,140,594 | 2/1979 | Rogers, Jr. et al. | 204/67 |
| 4,151,061 | 4/1979 | Ishikawa et al. | 204/247 |
| 4,308,115 | 12/1981 | Foster, Jr. et al. | 204/67 |

*Primary Examiner*—T. Tung
*Assistant Examiner*—Nathan Thane
*Attorney, Agent, or Firm*—McDougall, Hersh & Scott

[57] ABSTRACT

A cell for producing a metal by electrolysis of an anhydrous metal halide in a bath of molten salts comprises an external jacket of substantially parallelipipedal shape, having cooling means, ports for the input and output of liquid and gaseous fluids and means for supplying electricity, the lower end of the jacket includes a receptacle zone to collect the metal produced; a plurality of stacked electrodes in the central portion of the cell, each stack comprising, in a vertical direction and in descending order, a current supply electrode, intermediate multipolar members and a current output electrode, defining regular interpolar spaces; and a gas collecting zone in the top portion. The cell is characterized in that the multipolar members are assembled in a vertical stack, and the interpolar spaces are substantially vertical. The cell is particularly well adapted for the production of aluminum by electrolysis of the corresponding chloride.

21 Claims, 5 Drawing Figures

CELL FOR THE ELECTROLYTIC PRODUCTION OF METALS FROM METAL HALIDES

BACKGROUND OF THE INVENTION

The present invention relates in general to a cell for the electrolytic production of metals by electrolysis of anhydrous metal halides in a bath of molten salts, and in particular, to the electrolytic production of aluminum from the corresponding anhydrous chloride.

Experts in the art have long referred to the process of igneous electrolysis of alumina in a molten mixture of sodium and aluminum fluorides in the design of arrangements for igneous electrolysis of anhydrous aluminum chloride in a bath of molten salts.

The large number of literature references in this field is the consequence of certain observations made by experts, concerning the advantages that such a process might have over the Hall-Heroult process; e.g., that electrolysis could take place at a lower temperature, and that there could be a reduction in the consumption of electrodes through oxidation of their constituent graphite, due to the oxygen which is liberated during electrolysis of the alumina.

Several major disadvantages, however, soon became apparent and prevented the process from being exploited commercially.

Indeed, as expressed in French Pat. No. 2,158,238, experts were confronted with particularly troublesome phenomena, since the most serious disadvantages are due to the presence of dissolved or non-dissolved metal oxides, such as alumina, silica, titanium oxide or iron oxide in the electrolytic bath.

The non-dissolved metal oxides result in a gradual accumulation of a viscous layer on the graphite cathodes. The viscous layer comprises finely divided solids, liquid constituents of the bath and droplets of molten aluminum. These components impede access to the cathodes of the electrolytic bath and may cause problems in the normal cathode mechanism. Specifically, the components may lead to reduction of the cations containing the metal which are produced at various stages of oxidation. Thus, the aluminum chloride which is present in the viscous layer then consumed by electrolysis becomes increasingly difficult to replenish, and consequently the other chlorides in the bath of molten salts may be electrolyzed, resulting in a loss of efficiency in the electrical energy used and pollution of the metal.

Moreover, because the chlorides forming the bath of molten salts including alkali chlorides (e.g., sodium, potassium and/or lithium) and alkaline earth chlorides (e.g., magnesium, calcium and/or barium), are partially electrolyzed, incomplete renewal of the aluminum chloride near the cathode takes place producing the corresponding metals, which are inserted by cathode potential in the graphite of the electrodes and cause the cathodes to disintegrate and crumble. This premature wear on the cathodes causes particles of carbon to enter the bath. Those particles contribute to the formation of sludges at the cathode and lead to a reduction in yield.

Finally, another equally serious disadvantage, which has to do with the presence of dissolved metal oxides in the bath, such as alumina, is that oxygen is liberated at the anode and consumes the carbon which forms the anode. This consumption upsets the electrolytic operation, since it changes the geometric properties of the anode and particularly the distance between the anode and cathode.

Since the above-mentioned disadvantages were caused by the available processes, experts directed their research efforts to an apparatus for igneous electrolysis of anhydrous aluminum chloride in a bath of molten salts.

Apart from the above-mentioned drawbacks, what had to be studied and resolved was how to obtain a high yield of electrical energy, for example, by means of a low voltage and a high yield of current, while limiting any inverse reaction of the chlorine-aluminum type.

Thus, experts proposed the use of cells with bipolar electrodes to obtain at least some of the desired improvements mentioned above. Cells of this type have been produced, enabling such electrodes to be used either in a horizontal or inclined position so that the metal formed on each cathode surface is deposited in the bottom of the cell by gravity, and so that the chlorine produced on each anode surface is displaced in the opposite direction to the metal. Therefore, the chlorine migrates freely to the top of the cell without establishing any contact with the liquid metal.

A cell of the above type with bipolar electrodes is described in French Pat. No. 2,152,814. The cell comprises, horizontally stacked and in descending order, an anode, at least one intermediate bipolar electrode and a cathode, which are superposed and evenly spaced by insulating refractory struts. Substantially horizontal spaces are thereby created between the electrodes, for the purpose of electrolyzing the aluminum chloride in a bath of molten metals in each interpolar space. This leads to the liberation of chlorine from each anode surface and the deposit of aluminum on each cathode surface.

As a means for making the bath circulate well into each interpolar space and encouraging the metal formed to be carried out of the spaces, the chlorine produced performs the function of a delivery pump, carrying the lightest part of the bath to the surface and encouraging the aluminum obtained to be decanted to the bottom of the cell, both through appropriate passages. To this end, each bipolar electrode is equipped with an absolutely flat cathode surface and an anode surface with transverse hollowed channels.

Thus, each anode surface comprises a plurality of such channels extending transversely to the lateral edge of each electrode at the side where a passage is reserved for the return of the bath and the ascent of the gas. The purpose of the channels is to keep the chlorine that is liberated from the interpolar space away from the aluminum deposited on the cathode surface to limit rechloridation of the metal produced.

Another cell of the above type, with bipolar electrodes, is described in French Pat. No. 2,301,443, and is an improvement of the cell described in French Pat. No. 2,152,814. The cell comprises, in descending order and placed horizontally, an upper anode; intermediate bipolar electrodes, which are stacked on one another with spaces therebetween and maintained at equal distances by insulating refractory struts creating regular, virtually horizontal inter-electrode spaces, each space being defined at the top by the bottom surface of an electrode which acts as an anode surface, and at the bottom by the top surface of an electrode which acts as a cathode surface; and a bottom cathode.

As in the previously described patent, the anode surface may contain transverse channels to encourage the chlorine to flow out of the inter-electrode space to a zone for the ascent of gases. The channels are formed in the central part of the cell between the stacks of electrodes, the zone widening out from the bottom towards the top of the cell. Thus, the provision of channels on the anode surface leading to a zone for the ascent of gases, formed in the central part of the cell between the stacks of electrodes, is designed to rapidly remove the chlorine liberated from the interpolar space, but above all to remove the aluminum deposited on the cathode surface in order to limit its rechloridation.

Although such technology can bring substantial, remarkable improvements in the electrolysis of aluminum chloride, it has to be admitted that the arrangements proposed still have serious enough disadvantages to hamper their optimum use in industrial processes.

Apart from the fact that channels for discharging the gases liberated have to be provided on the anode surface to prevent the gases from accumulating in the interpolar space, thus making the industrial production of this type of electrode particularly expensive, such electrolytic cells are the subject of many disturbances relating to the existence of parasitic tapped currents produced by non-consecutive electrodes positioned too close together.

Moreover, such electrolytic cells suffer from thermal imbalance as a result of the disproportion between the energy dissipated at the center of the cells and the external radiating surface.

Finally, such cells suffer from the continued existence of the droplets of aluminum produced only a short distance away from the anode. This creates a considerable danger that a fraction of the aluminum produced may be reoxidized; such reoxidation would upset the thermal balance because of its exothermic character.

With a realization of the interest which experts in the field would have in a new cell, well adapted to the electrolysis of metal halides, and more particularly aluminum chloride in a bath of molten salts, but also with an awareness of the disadvantages attached to the techniques previously described in this field, applicants have continued their research and have designed and perfected an improved cell for the electrolysis of these halides, which is virtually free from the described disadvantages.

SUMMARY OF THE INVENTION

According to the present invention, a cell for electrolytically producing a metal by electrolyzing an anhydrous metal halide in a bath of molten salts comprises an external jacket of substantially parallelipipedal shape having cooling means, ports for the input and output of liquid and gaseous fluids and means for supplying electricity, the lower portion of the jacket includes a receptacle zone to collect the metal produced; at least one series of stacked electrodes in the central portion, each stack comprising, in a vertical direction and in descending order, a current supply electrode, intermediate multipolar members and a current output electrode defining regular interpolar spaces between the members; and a gas collecting zone in the top portion. The cell is characterized in that the multipolar members are assembled in a vertical stack, and the interpolar spaces are substantially vertical.

The intermediate multipolar members are stacked prismatic members of a cross-section which generally has a shape resembling the letter Y.

Each prismatic multipolar member has an upper, trough-shaped portion which acts as a cathode surface and is defined by the two upper limbs of the Y, the walls of which have a constant thickness. A lower portion, the vertical or oblique ventral bone defined by the tail of the Y, acts as an anode surface the thickness of which is at least equal to that of the walls of the trough, but is preferably twice the thickness of each of the upper limbs. In this manner, the lines of current can be distributed as homogeneously as possible within the interpolar spaces.

The end of each upper limb of the trough cross-section (the Y-shaped section), may depart from the axis of symmetry of the two upper limbs to avoid the disturbances which might occur in that zone between the multipolar members.

The thickness of the trough walls of each multipolar member is generally from 10 to 100 mm and is preferaly from 25 to 50 mm.

The bottom of the trough, formed by the upper limbs of the Y-shaped section, may be provided with a longitudinal channel, formed by a groove, which helps to collect and discharge the metal obtained during electrolysis.

The multipolar member is generally obtained by extruding a carbon paste, followed by calcination and graphitization by known methods.

The cathode part of the multipolar members may further be coated with a layer of zirconium diboride or titanium chloride.

The height of each multipolar member is generally at least 200 mm and may preferably be from 300 to 500 mm. This height is neither limited nor critical with respect to the electrolyzing operation. It is generally defined by the user for each particular case and is not a structural limitation.

Similarly, the length of each multipolar member is defined by the dimensional charactistics of the particular cell.

To form the electrodes arranged in the cell according to the invention, the prismatic multipolar members are stacked one above the other and are wedged together by insulating refractory components which are resistant to the aggressive action of the medium. The top member, for supplying the current, is a prismatic component preferably without any trough, the cross-section of which may be cross-shaped, T shaped or I shaped or formed merely by the tail of the Y section. The bottom member, for outputting the current, is a prismatic component with a cross-section similar to the letter X, the letter M or the letter N.

The various prismatic members may be stacked horizontally or may be very slightly inclined, according to the slope of the member resting on the bottom of the cell. In the latter case, the liquid metal is helped to flow.

In a particularly interesting alternative embodiment, it is possible for the multipolar members in each stack to be offset longitudinally from one another, so that the threads of liquid metal escaping from the troughs in the superposed members do not come into contact. This prevents short circuiting between the various members of the same stack.

In another alternative embodiment, which may be combined with the previous one, the lower end of the ventral bone of the multipolar member can be provided with a device for guiding the thread of liquid metal, e.g., of the "pouring spout" type, so that its flow is effectively channelled.

The stacking of the multipolar members with the wedging components interposed provides even spacing between the members and creates homogeneous interpolar zones, thus ensuring that the electrolytic bath is satisfactorily recirculated.

The bottom member dips into at least one thread of liquid metal in contact with the current output device.

Similarly, the top member is connected to the electrical conductor by known means; for example, by bedding graphite components or bars of copper or steel.

In cases where the line supplying electric current to the anode consists of hollow cylindrical components made of graphite, these may act as ports for discharging the gaseous effluents produced during electrolysis.

Since the multipolar members are regularly stacked, a plurality of the stacks can be placed parallel with one another and connected to the above-mentioned electrical sources. The liquid metal in the receptacle zone at the bottom of the cell therefore can act as an equipotential connector for all the parallel stacks.

The adjacent stacks are regularly positioned, both relative to one another and relative to the walls of the cell, by means of molded wedges and possibly other moldings of insulating refractory materials and by means of horizontal of sloping grooves made in the sole plate of the cell.

The electrolytic bath, previously enriched with metal chloride then purified, is fed into the cell through ports at the bottom, while the excess bath exhausted by the electrolytic operation is discharged by overflowing at the top of the cell or by siphoning.

The bath is recirculated into the interpolar spaces by the mechanical drive provided by the liberation of gaseous chlorine, mainly along the side walls.

BRIEF DESCRIPTION OF THE DRAWINGS

The invention will be better understood with reference to the following figures.

DETAILED DESCRIPTION OF THE INVENTION

Figure 1:
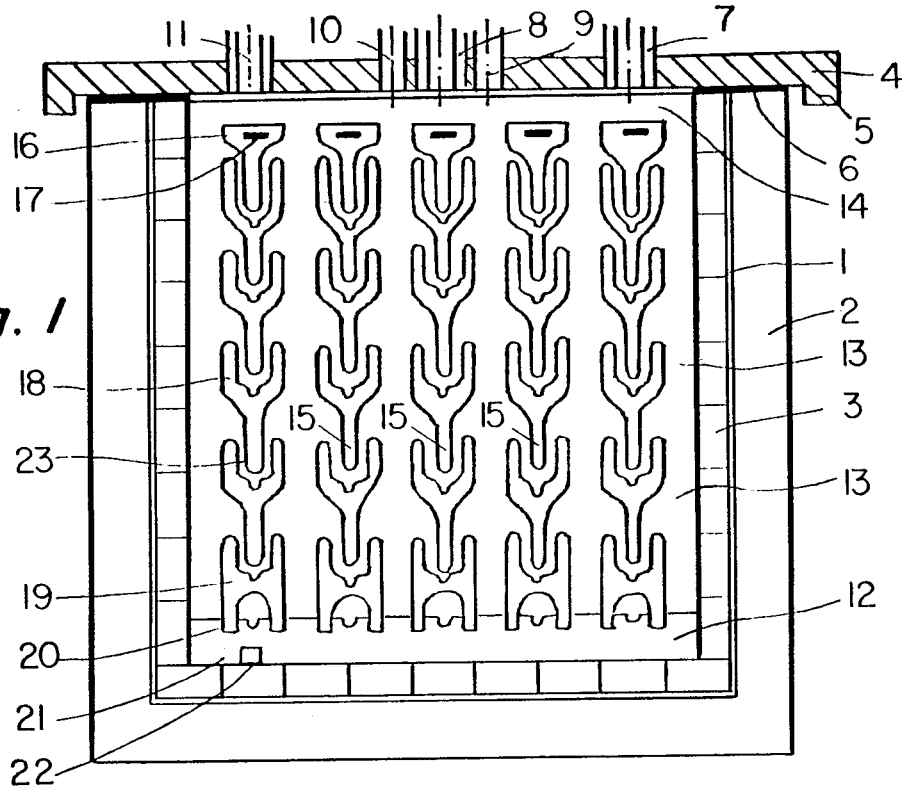
FIG. 1 is a cross-sectional side view of an electrolytic cell according to the invention.

Referring to FIG. 1, the cell for electrolyzing anhydrous metallic chlorides in baths of molten salts comprises a jacket 1 made of refractory steel, which is fitted with cooling fins 2 and is provided with an internal cladding 3 resistant to the action of the chlorine and the bath of molten salts including, but not limited to, silicon nitride, silicon oxynitride, silicon carbonitride or boron nitride. A cover 4 which is fitted with a rim 5 and which closes the cell at the top through the provision of an impervious means 6 contains ports which allow passage of current supply lines 7, pipes feeding in the bath enriched with metallic chloride 8, pipes to discharge the bath with a diminished chloride content 9 and to discharge the liquid metal 10, and other ports 11 for discharging the gaseous effluent.

The internal surface of the cover 4, which is directly exposed to the aggressive vapors from the bath of molten salts and to the gaseous effluent resulting from electrolysis, is made of an appropriate resistant material, such as alloys containing nickel, chromium, iron, copper or molybdenum. Moreover, the internal surface can be coated with protective ceramics and/or provided with cooling means.

The interior of the electrolytic cell comprises a bottom zone 12 for collecting the liquid metal produced, a zone of electrolysis 13 in the center that is filled with the bath of molten salts enriched with metallic chloride, and a top zone 14 where the gaseous effluents are collected so that they can be discharged through the ports 11.

The various ports mentioned above, which are necessary for the satisfactory operation of the cell and which are located in the cover 4, each have a special function. A first port 10, extending through the cover into the upper 14, central 13 and lower zones 12, allows for the insertion of a tube for the removal of the liquid metal. Another port 8 provides the means for admitting the bath enriched with metallic chloride, while the port 9 enables the bath with a reduced chloride content to be discharged, and the port 11 provides an outlet for the gaseous effluent.

Inside the vat of the electrolytic cell according to this invention, vertical stacks 15 of electrodes are arranged in a parallel conformation and are equally spaced. Each stack 15 comprises a current input electrode 16 equipped with a supply bar 17 which is embedded in the electrode and is connected to the current supply 7 passing through the cover 4; multipolar intermediate members 18; and a current output electrode 19 which fits into grooves 20 in the base 21 of the vat, which may have current output bars 22 embedded therein.

The intermediate multipolar members 18 form even, substantially vertical interpolar spaces 23 therebetween.

Figure 2:
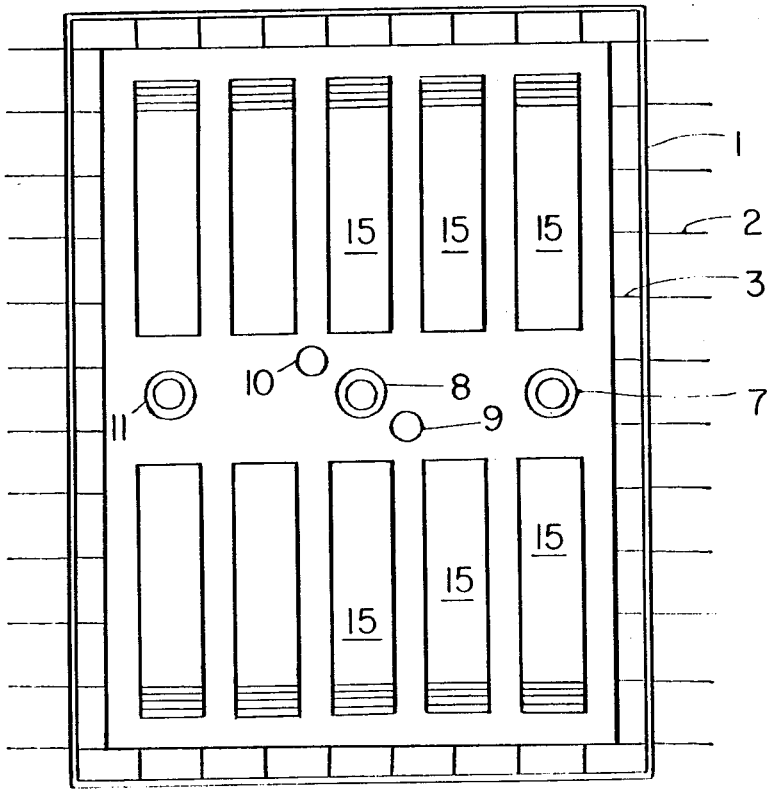
FIG. 2 is a horizontal sectional view through the electrolytic cell, showing the arrangement of the stacks of electrodes.

Referring now to FIG. 2, which is a horizontal sectional view through the cell of the invention, the cell comprises the jacket 1 made of refractory steel which is fitted with cooling fins 2 and provided with an internal cladding 3 resistant to the action of the bath of molten salts and the chlorine. The cell further comprises the ports 7 for the current supply lines, ports 8 for admitting the bath enriched with metallic chloride , ports 9 for removing the bath with a reduced chloride content as a result of electrolysis, ports 10 for discharging the liquid metal and ports 11 for removal of the gaseous effluent.

The cell also has ten vertical stacks 15 of the above-mentioned multipolar electrodes.

Figure 3:
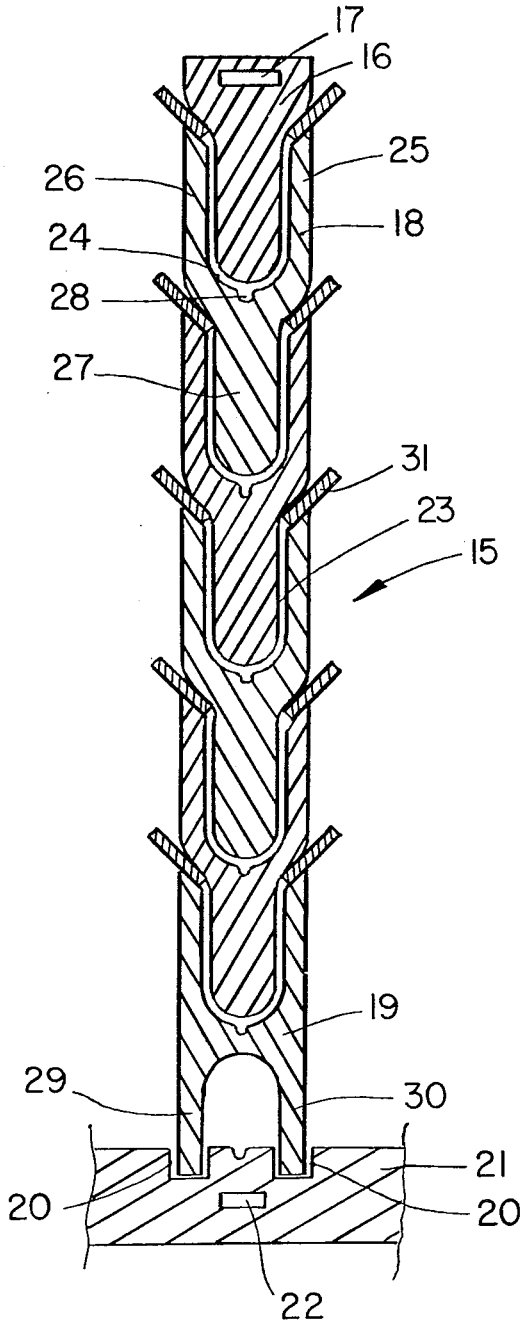
FIG. 3 is a sectional view through a stack of electrodes.
Figure 4:
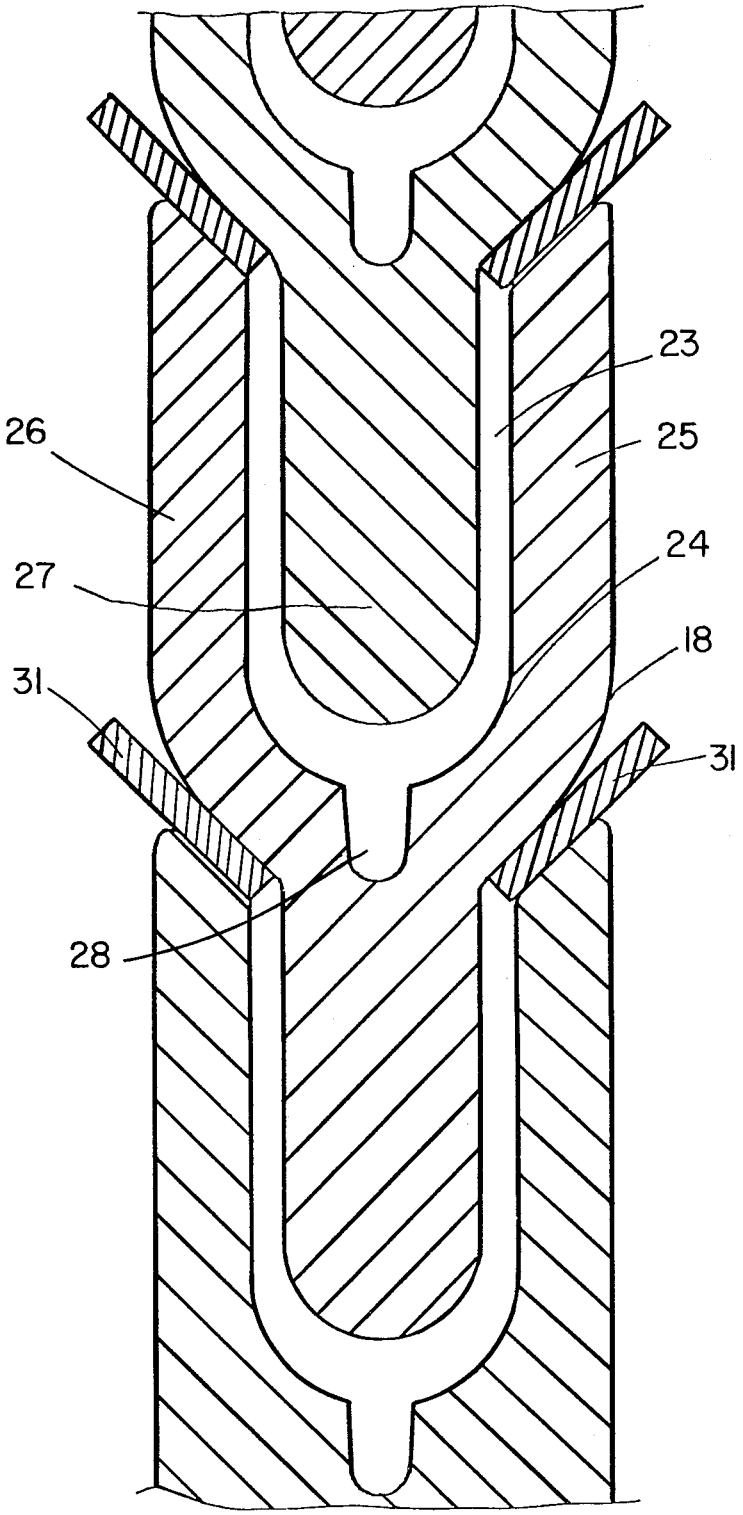
FIG. 4 is an enlarged sectional view through an intermediate member.

In FIGS. 3 and 4, which are cross-sectional views through a stack of electrodes, the stack consists of a current input electrode 16, intermediate multipolar members 18 and a current output electrode 19.

The current input electrode 16 which is a prismatic component made of graphite, the cross-section of which is formed by the tail of the letter Y, is also equipped with a current supply bar 17 embedded in the material and connected to the current supply 7 (not shown).

The intermediate multipolar members 18 which again consist of a prismatic component made of graphite have a cross-section in a vertical plane of symmetry similar to the letter Y.

Each intermediate multipolar member 18 has an upper, trough-shaped portion 24 defined by the two upper limbs 25 and 26 of the Y, and a lower portion 27 referred to as the ventral fishbone; this is defined by the tail of the Y, which is at least as thick as the limbs or walls 25 and 26. The bottom of the trough 24 is provided with a longitudinal channel 28 formed by a groove which helps to collect and discharge the metal obtained by electrolysis.

The current output electrode 19 is also a prismatic component having a cross-section similar to the shape of the letter H. The lower limbs 29 and 30 of the H are fitted into the grooves 20 in the sole plate 21 in which the current output bar is embedded.

The various prismatic members making up the stack 15 are regularly spaced by interposing wedging components made of an insulating refractory material 31 and interpolar zones 23 are formed, also referred to as interpolar spaces. These zones provide for satisfactory recirculation of the electrolytic bath, good recovery of the molten metal and excellent discharge of the gaseous effluent between the walls 25 and 26 of the trough and the ventral bone.

With this new technology, the multipolar members are assembled in a vertical stack with vertical interpolar spaces. This prevents the molten metal flowing to the bottom of the vat from meeting the gaseous effluents migrating towards the top of the cell.

Figure 5:
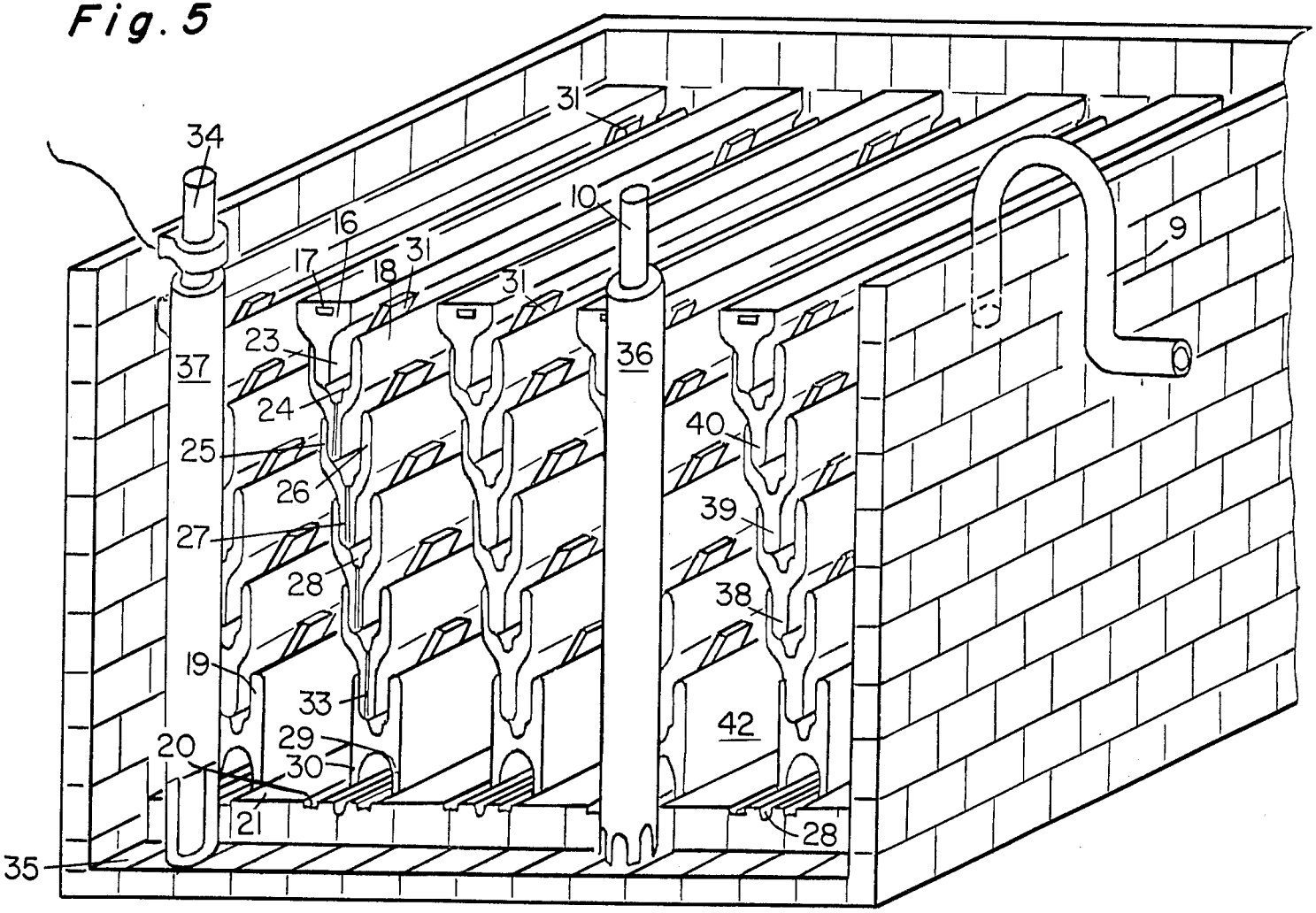
FIG. 5 is a cutaway perspective view showing the inside of the cell according to the present invention.

In FIG. 5, which is a cutaway perspective view of the inside of the cell according to the invention, the stacks 15 of electrodes are arranged in parallel and are equally spaced, as already explained. Each stack comprises a current input electrode 16, followed by intermediate multipolar members 18 and an electrode 19 for drawing off the current.

The current input electrode 16, which is a prismatic component made of graphite, is equipped with a current supply bar 17 connected to the power supply (not shown).

Each intermediate multipolar member 18 formed by a prismatic graphite component comprises an upper, trough-shaped portion 24 that is defined by the walls 25 and 26, and the lower portion 27 (the ventral bone). The bottom of the trough 24 is provided with a longitudinal channel 28 formed by a groove which helps to collect and discharge the metal obtained by electrolysis of the metal chloride.

The current output electrode 19 which is a prismatic component made of graphite, has two lower walls 29 and 30, which fit into inclined grooves 20 in the sole plate 21 of the cell.

The electrode 19 is connected to the current output terminal 34 by the liquid metal which is in the collector 35 at the bottom of the vat. The bottom of the tube 10 for discharging the molten metal, and the bottom of the output terminal 34 dip into the collector and are protected by their respective sheaths 36 and 37 made of insulating refractory materials.

The various prismatic members which make up a stack are kept evenly spaced from one another by interposing wedging members 31 made of insulating refractory material, thus creating interpolar spaces 23.

The various prismatic members 16, 18 and 19 have a slight slope, which encourages the metal to flow along the longitudinal channels 28.

Furthermore, the stack components 16, 18 and 19 are offset longitudinally from one another as can been seen, for example, from intermediate members 38, 39 and 40. In this way, the threads of liquid metal escaping from the trough 24 in each of the prismatic members through the longitudinal channel 28 cannot come into contact with one another. This prevents any short circuiting between the various prismatic components of the same stack.

The ventral bone 27 is similarly provided with a device 33 for guiding the thread of liquid metal. This device is in the nature of a pouring spout that effectively channels the flow of metal.

The bath of molten salts has not been shown in FIG. 5, to allow the internal structure of the cell according to the invention to be clearly seen and understood. The level of the electrolytic bath in the cell may vary during the operation, but all the interpolar spaces must be submerged.

During electrolysis of the metal chloride in the bath of molten salts, a preferred passage for the ascent of the gaseous effluent is set up in the interpolar spaces 25, defined by the upper walls 25 and 26 of an intermediate prismatic member and the ventral bone 27 with another such member fitted into the former one. The passage, thus reserved for the ascent of the gaseous effluents on both sides of each intermediate member of a stack, enables the bath of molten salts to circulate in the interpolar spaces. The bath is made to flow by the rising of the gaseous effluents produced by electrolysis in the interpolar spaces 23.

Therefore, when the gaseous effluents leave each interpolar space 23, the gases emerge, collect in the inter-stack space 42 and flow in the desired direction; i.e. from the bottom towards the top of the cell leaving the cell through the port 11 which extends through the cover 4.

During this same electrolysis of the metal chloride in the bath of metal salts, the molten metal on the cathode surfaces flows into the trough 24 of each interpolar space 23 through the longitudinal discharge channel 28, drops into the liquid metal zone 12 and is gathered together in the liquid metal collector 35 from where the metal is discharged by the draining means 10.

The current can be uniformly drawn off by means of the output terminal 34 which dips into the liquid metal in the collector 35.

As a result of (a) the substantially vertical interpolar spaces 23, which guide the ascent of the gaseous effluents; (b) the longitudinal channels 28 for discharging liquid metal from the bottom of the troughs 24; and (c) the slight slope of the intermediate multipolar members 18 and the offsetting of each multipolar member, such as those illustrated by 38, 39 and 40, which direct the liquid metal from each intermediate multipolar member to the bottom of the cell while keeping the gaseous effluents apart from the liquid metal, there can consequently be no rechloridation of the electrolyzed metal by the gaseous effluents and no short circuiting between intermediate multipolar elements.

Finally, with the bath of molten salts inside the cell being kept at a virtually constant level, the bath exhausted of electrolyzed metal chloride is discharged through the port 9, while the bath enriched with the metal chloride to be electrolyzed is introduced via the feed means 8 (not shown).

EXAMPLE 1

With reference to FIGS. 1 and 5, a cell for electrolysis of an anhydrous aluminum chloride was made, according to the invention, comprising a jacket 1 made of refractory steel, fitted with cooling fins 2 and provided with an internal cladding 3 resistant to the action of chlorine and baths of molten salts based on alkaline chloroaluminate. The cladding consisted of a pile of bricks made of silicon carbonitrides with lapped joints held by a grout based on silicon nitride.

Inside the cell were two vertical stacks 15 providing five interpolar spaces. These were made with intermediate members having a cross-section substantially shaped as a letter Y, a height of 35 cms, a length of 50 cms and a maximum width of 14 cms.

The multipolar members were made of graphite and their upper limbs 25 and 26 were 3 cms thick, while the lower limb 27, described as the ventral bone, was 6 cms thick.

A very slight slope (of 5% relative to the horizontal) was maintained between each intermediate multipolar member 18 in each stack 15, in order to accelerate the discharge of effluents from the interpolar space 23.

The intermediate multipolar members were separated from one another by wedges made of silicon nitride, a material resistant to the corrosion of the medium, thus providing a spacing of 1 cm between each element in the substantially vertical portion.

The bottom of the trough 24, a little further away from the ventral bone 17, defined by the walls 25 and 26, was provided with a longitudinal channel 28 being 2 cms wide and 3 cms high.

The current supply electrode 16 was itself connected to the power supply circuit by a current supply bar 17.

The electrode 19 for leading out the current was in contact with the liquid metal. The current was output through a steel bar bedded in the carbon sole plate.

The bath for electrolyzing the aluminum chloride, on entering the vat, consisted of 18.8% LiCl, 28.2% NaCl and 53% of $AlCl_3$ (by weight).

The bath was kept at a temperature of 720° C.+10° C. $AlCl_3$ was added through the feed port 8 while the low concentration liquor was discharged by overflow through the port 9. The rate at which the high concentration liquor was fed was 62 kg/h. This rate was controlled by measuring the conductivity of the liquor, using a conductimetric cell and a level detector (not shown).

The conditions under which the cell operated were as follows:

Current density per $cm^2$—1.2 $A/cm^2$
Intensity passing through cell—3840 A
Average daily weight of Al produced—144 kg
Current yield—93%
Voltage drop at terminal—13.5 V
Hourly consumption of electricity per ton of aluminum produced—8640 Kwh/t
Weight of $AlCl_3$ fed in per hour—33 kg
Weight of high concentration liquor fed in per hour—62 kg
Operating time—3700 hrs The aluminum produced was extracted by suction from inside the draining means 10 provided in an insulating refractory tube. The chlorine was discharged with the other gaseous effluents through the tube 11.

Thus, applicants found that regular outputs of chlorine and aluminum could be obtained without rechloridation of the metal or short circuiting between the intermediate multipolar members.

EXAMPLE 2

A cell for electrolyzing aluminum chloride according to the invention was set up, including the same intermediate multipolar members as in Example 1, but where the cathode portion (inner wall of the trough) had been covered with a mixture of 60% by weight of zirconium diboride and 40% by weight of high temperature coal tar calcined at 1200° C.

Inside the cell, five pairs of adjacent stacks with five interpolar spaces were spaced 5 cms apart, the current supply electrode of each stack being linked by a graphite equipotential connection. The stacks were symmetrical relative to the collecting channel.

The bath for electrolyzing the aluminum chloride was of the following composition (by weight) on entering the cell:

LiCl: 18.8%
NaCl: 28.2%
$AlCl_3$: 53% and was kept at a temperature of 720° C.±10° C. The high concentration liquor was fed in at 248 kg/h. The feed rate was controlled according to the response from a conductimetric cell and a level detector (not shown).

The conditions under which the cell operated were as follows:

Current density per $cm^2$—0.94 $A/cm^2$
Intensity passing through cell—1500 A
Average daily weight of Al produced—575 kg
Current yield—95%
Voltage drop at terminals—12.4 V
Hourly consumption of electricity per ton of aluminum produced—7760 Kwh/t
Weight of $AlCl_3$—131 kg
Weight of bath enriched with $AlCl_3$ per hour—248 kg
Operating time—2500 hrs In this example the current was output by a steel bar bedded in the sole plate.

It will be noted that there was a gain of 1100 millivolts at the terminals of the vat as compared with Example 1. This improvement resulted (a) from a substantial reduction in current density, a phenomenum well known in the art, and (b) from the yield due to a reduction in the rediffusion of the aluminum produced to the anode, owing to the zirconium diboride coating.

EXAMPLE 3

A cell for electrolyzing aluminum chloride according to the invention was assembled, using the same type of stack as in Example 2, but with the intermediate cathode members and the current output electrodes coated with titanium diboride.

The bath for electrolyzing the aluminum chloride was of the same compositon as before and was kept at a temperature of 720° C.+10° C. The rate at which the high concentration bath was fed in was 248 kg/h; this was controlled by measuring the conductivity of the bath and using a level detector.

The conditions under which the cell operated were as follows:

Current density per $cm^2$—0.94 $A/cm^2$
Intensity passing through cell—15000 A
Average daily weight of Al produced—575 kg
Current yield—95%
Voltage drop at terminals—12.7 V
Hourly consumption of electricity per ton of aluminum produced—7950 Kwh/t
Weight of $AlCl_3$—131 kg
Weight of bath enriched with $AlCl_3$ per hour—248 kg
Operating time—3000 hrs Thus a decrease in the cathode drop was noted, as compared with Example 1. That decrease was due to the presence of the titanium diboride coating.

The fact that the steel current output bars, embedded in the sole plate and emerging from the bottom of the cell, were replaced by the graphite terminal 34 that was covered with titanium diboride produced a slight increase in the voltage drop at the terminals of the cell, but the cell was made more impervious and the risks of infiltration were reduced.

It will be understood that various changes and modifications can be made in the above-described apparatus without departing from the spirit thereof, particularly as defined in the following claims.

I claim:

1. A cell for electrolytically producing metal by electrolysis of a metal halide in a bath of molten salts comprises:

(a) an external jacket of substantially parallelipipedal shape provided with cooling means, ports for the input and output of liquid and gaseous fluids and means for supplying electricity, the lower end of said jacket including a receptacle zone to collect the metal produced;

(b) a plurality of stacked electrodes in the central portion, each stack comprising, in a vertical direction and in descending order, a current supply electrode, intermediate multipolar members and a current output electrode, defining regular interpolar spaces; the intermediate multipolar members include an upper portion having two upper limbs which form a trough and a lower portion forming a ventral bore, the cross-section through the members having a shape similar to that of the letter Y; and (c) a gas collecting zone in the top portion of the cell whereby the multipolar members are assembled in a vertical stack and the interpolar spaces are substantially vertical.

2. A cell according to claim 1 wherein the intermediate multipolar members comprise prismatic carbon members.

3. A cell according to claim 1 wherein the upper portion defined by the two upper limbs of the Y has a constant wall thickness and the lower portion forming the ventral bone has a wall thickness at least equal to the wall thickness of an upper limb.

4. A cell according to claim 3 wherein the lower portion has a wall thickness equal to twice the wall thickness of an upper limb.

5. A cell according to claim 1 wherein the upper ends of the two upper limbs of the upper portion depart from the axis of the two upper limbs in a widening out direction.

6. A cell according to claim 3 wherein the thickness of an upper limb that forms the trough is between 10 and 100 mm.

7. A cell according to claim 3 wherein the thickness of an upper limb that forms the trough is between 25 and 50 mm.

8. A cell according to claim 1 wherein the height of each multipolar member is at least 200 mm.

9. A cell according to claim 1 wherein the height of each multipolar member is between 300 and 500 mm.

10. A cell according to claim 1 wherein the bottom of the trough formed by the upper limbs of the upper section includes a longitudinal groove which helps to collect the metal.

11. A cell according to claim 1 wherein the end of the ventral bone of the multipolar intermediate member includes a device for guiding a stream of liquid metal.

12. A cell according to claim 1 wherein the vertical stack of intermediate multipolar members has an upper current supplying member formed by a prismatic carbon component with a cross-shaped, T-shaped or I-shaped cross-section.

13. A cell according to claim 1 wherein the vertical stack of intermediate multipolar members has a bottom current-output member formed by a prismatic carbon component with a cross-section similar to that of the letters H, M or N.

14. A cell according to claim 1 wherein the intermediate multipolar members are stacked evenly by interposing wedges of an insulating refractory material between pairs of members.

15. A cell according to claim 1 wherein the stacked intermediate multipolar members are horizontal relative to a horizontal plane.

16. A cell according to claim 1 wherein the stacked intermediate multipolar members are inclined relative to a horizontal plane.

17. A cell according to claim 1 wherein the stacked intermediate multipolar members are offset longitudinally from one another to avoid the formation of short circuits between the various members of the same stack caused by the flowing of the metal.

18. A cell according to claim 1 wherein the cathode surface of each multipolar member made of graphite is covered with zirconium diboride.

19. A cell according to claim 1 wherein the cathode surface of each multipolar member made of graphite is covered with titanium diboride.

20. A cell according to claim 1 wherein current output is provided by a bar formed of a material selected from the group consisting of steel, copper or graphite which is formed in the lower end of the cell.

21. A cell according to claim 1 wherein current output is provided by a vertical terminal isolated from the electrolytic bath, which contacts a sheet of liquid metal.

* * * * *